United States Patent [19]

Fujimoto et al.

[11] 4,143,570

[45] Mar. 13, 1979

[54] FEEDING AND CUTTING CONTROL MECHANISM FOR ROLL STORED PAPER

[75] Inventors: Hirohisa Fujimoto; Norihiko Suzuki, both of Toyokawa; Kenji Shibazaki, Aichi; Kenichi Arai, Toyokawa, all of Japan

[73] Assignee: Minolta Camera Kabushiki Kaisha, Osaka, Japan

[21] Appl. No.: 797,896

[22] Filed: May 17, 1977

[30] Foreign Application Priority Data

May 25, 1976 [JP] Japan ..... 51-67313[U]

[51] Int. Cl.[2] ..... B26D 5/20

[52] U.S. Cl. ..... 83/205; 83/298

[58] Field of Search ..... 83/205, 298

[56] References Cited

U.S. PATENT DOCUMENTS

| | | | |
|---|---|---|---|
| 3,710,664 | 1/1973 | Eveland | 83/205 X |
| 3,797,347 | 3/1974 | Miciukiewicz et al. | 83/205 |
| 3,888,147 | 6/1975 | Ravera | 83/205 X |
| 3,925,786 | 12/1975 | Haas | 83/205 X |
| 4,027,965 | 6/1977 | Mikasa et al. | 83/205 X |

*Primary Examiner*—Willie G. Abercrombie

*Attorney, Agent, or Firm*—Wolder, Gross & Yavner

[57] ABSTRACT

A mechanism for withdrawing and cutting sheet from a storage roll thereof to predetermined lengths includes a feed roll driven by a clutch transferrable between engage and disengage conditions and a shaft rotatable single cycle cutting blade located forward of the feed roll. The shaft is spring biased in a blade sheet cutting forward direction and means are provided for loading the spring following its unloading. The shaft is releasably locked in a blade retracted position and is releasable by a first solenoid to effect a cutting cycle and a timing member rotatable with the shaft acts through a motion transmission to disengage the clutch and releasably lock it in disengage position at least during the cutting of the sheet. Following the cutting cycle, the clutch may be actuated to its engage position by the energization of a second solenoid. Alternatively, the clutch may be fully controlled by the second solenoid by a circuit network responsive to the positions of the timing member.

7 Claims, 14 Drawing Figures

FEEDING AND CUTTING CONTROL MECHANISM FOR ROLL STORED PAPER

BACKGROUND OF THE INVENTION

The present invention relates generally to improvements in feeding and cutting control mechanisms for roll type paper and it relates more particularly to an improved control mechanism for controlling the feeding and cutting sequences of paper unwound and drawn from roll storage.

In general, a paper or sheet wound in roll form is utilized in various fields and is fed and cut to predetermined lengths. In the field of electrophotography, the paper is used as copying paper for forming a duplicate of an original to be copied thereon and various devices for cutting the copying paper drawn from a roll storage are known. One example of such a device is shown in U.S. Pat. No. 3,665,796 in which a cutter blade is operated while transporting or feeding the copying paper. In this device, a loop forming means is provided between a cutter and a succeeding transporting means for forming a loop in the paper. The cutting of the paper is accomplished while continuing the transportation by the succeeding transporting means with a loop of the paper formed by the loop forming means paid out during the cutting operation so that the paper at the cutter may be stationary. While this device effectively performs the cutting operation, the loop forming means is required and in addition, the paper cannot be transported at high speed.

Another type of cutting device hithertofore known is similar to the device described above, but without the mechanism for forming the loop. Specifically, this type of cutting device operates a cutter blade at high speed while transporting the paper and accordingly allows the cutting of the roll paper without producing an abnormal tension which would adversely effect the succeeding transporting means or the roll paper itself, and thus dispenses with any special mechanism for use in the transportation or feeding of the roll paper such as a loop forming means, with the resulting simplified construction of the machine as well as a reduction in the size thereof. However, such cutting devices suffer from a disadvantage in that after cutting, the length or amount of the leading edge of paper protruding to some extent from the cutting blade various from one cutting to another and this constitutes a critical disadvantage as the length of paper cut has a different length in each cutting due to the variances in the protruding amount of the leading edge of paper.

Various attempts have been made to overcome this disadvantage and one of such attempt is the provision of means for generating a signal for deenergizing paper feeding rollers which are located at a position preceding the cutter blade and for energizing the cutter simultaneously. However, this causes the paper to be stretched excessively during the cutting operation and results in the tearing of the paper. Another attempt is the provision of a control mechanism which includes a cam means adapted to be driven synchronously with the transportation of the paper and the generation of signals sequentially with a minor time interval for energizing the cutter and for deenergizing the paper feeding rollers. However, this control mechanism still suffers from another disadvantage in that the time taken from the input of the signals until commencement of actual actuation of the cutter blade and the paper feeding rollers are not constant from one cutting operation to another and there is always some timing errors in the actual actuations. Accordingly, when the operation of the cutter blade and stoppage of the paper feeding rollers are separately effected with such minor time interval, the rotation of the paper feeding rollers may possibly be terminated before the cutter is operated or after the cutter is operated with an unexpected long delay. These instabilities result in unevennesses or variances in length of the leading edge of the paper protruding from the cutter from one operation to another as well as other various disadvantages.

OBJECTS AND SUMMARY OF THE INVENTION

It is accordingly an object of the present invention to provide an improved feeding and cutting control mechanism for roll type paper which avoids the aforesaid shortcomings.

Another object of the present invention is to provide a novel and improved control mechanism for controlling the feeding and cutting sequences of paper drawn from storage roll thereof.

Still another object of the present invention is to provide a reliable feeding and cutting control mechanism for roll type paper wherein the paper extending from the cutter after each cutting operation is nearly constant.

A further object of the present invention is to provide an improved feeding and cutting control mechanism for roll type paper which minimizes the amount of leading edge of the paper projecting from the cutter upon completion of a cutting operation.

It has been found that the aforesaid and other related objects of the present invention are attained in a feeding and cutting control mechanism for roll stored paper which includes a feeding means for feeding the paper, a clutch means for actuating the feeding means, a cutting means for cutting the paper and a transmission means for transmitting the operating action of the cutting means to the clutch mechanism wherein the feeding means is deactuated by the release of actuation or disengagement of the clutch means through the transmission means which is actuated by the actuation of the cutting means.

For a fuller understanding of the nature and objects of the present invention, refererence is made to the following detailed description taken in conjunction with the accompanying drawings which illustrate preferred embodiments of the present invention and in which like parts are designated by like reference numerals.

DESCRIPTION OF THE PREFERRED EMBODIMENTS

Before describing in detail the feeding and cutting control mechanism of the present invention, it should be noted that although the embodiments of the control mechanism of the present invention will be described in relation with an electrophotographic copying apparatus, the control mechanism may be utilized in any application requiring the use of roll type paper which is to be fed and cut into predetermined lengths.

Figure 1:
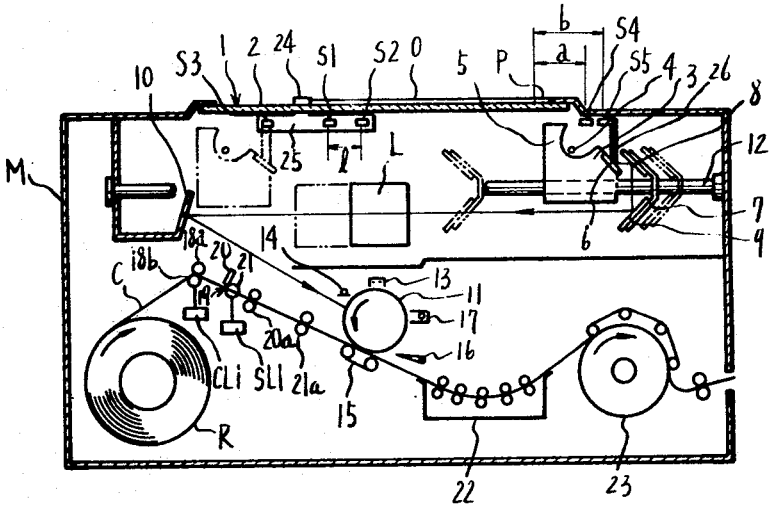
FIG. 1 is an over-all medial longitudinal cross-sectional view of a copying apparatus utilizing the feeding and cutting control mechanism of the present invention.

Referring now to FIG. 1 showing an electrophotographic copying apparatus utilizing a feeding and cutting control mechanism for roll stored type paper in accordance with the present invention, the apparatus M includes an original holder table 1 including a transparent glass plate 2 onto which an original O to be copied is placed. The glass plate 2 further includes a reference edge member P at one end thereof for aligning an end of the original with the edge thereof. Below the table 1 is disposed an optical scanning means which includes a first movable carriage 3 having an exposure lamp 4 backed by a reflector member 5 and a first reflector or mirror 6, a second movable carriage 7 having second and third reflectors or mirrors 8,9, a projection lens L and a fixed reflector or mirror 10 and which functions to scan and to project the image of the original onto a rotatable photosensitive member 11. As may be seen, the first and second carriage 3, 7 are moved at the speed ratio of 2 to 1 along a rail 12 parallel to the original on the table 1 to keep the optical length between the original O and the photosensitive member 11 always constant. Thus, as the image of the original is projected successively by the scanning movements of the carriages 3, 7, the image is projected onto the photosensitive member through the lens L and the fixed mirror 10 to form an electrostatic latent image on the photosensitive member 11.

The optical scanning means described above may be constructed with suitable variable magnification means so that copies of different magnification ratios may be obtained. To obtain a copy at other than 1:1 copying ratio, the second carriage 7 and the lens L are shifted for predetermined distances to the positions shown by phantom lines precedent to a copying operation and then the carriages 3, 7 are moved at the speed ratio of 2:1 but at speed different from the speeds at 1:1 copying ratio. For the specific mechanism of the optical scanning means and for the further understanding of the copying at various magnification ratio, reference is made to U.S. Pat. No. 3,884,574.

About and around the photosensitive member 11, a corona charging means 13 for charging the photosensitive member 11, an exposure slit 14 through which the projected image passes, an image transferring means 15 for transferring an electrostatic latent image onto a copying paper C the details of which are described in U.S. Pat. No. 3,814,012, a stripping member 16 for separating the copying paper and an erasing means 17 for erasing the residual charges from photosensitive member 11 are sequentially provided in the rotational direction of the photosensitive member 11.

The copying paper C is in the form of a roll R with the immediate withdrawn portion thereof being normally held in a nipped condition by a pair of intermittently driven feed rollers 18*a*, 18*b* connected to a clutch CL1. The copying paper C has its leading edge at a cutting means 19 having a fixed blade 20 and a single revolutional blade 21 associated with a solenoid SL1. The details of these will be described hereinafter in relation to a feeding and cutting control mechanism in accordance with the present invention. The copying paper C is fed from the cutting means 19 to the image transferring means 15 by plurality of pairs of transporting rollers 20*a*, 21*a* where the latent image is transferred and then the paper is separated by the stripping member 16 and developed by a developing means 22. The developed image is heat fixed by a fusing means 23 and discharged from the apparatus.

Referring again to FIG. 1, the original holder table 1 includes a slidable indicator member 24 slidable along the transparent glass plate 2 in the direction of the movements of the carriages 3, 7. The indicator member 24 is for manual alignment with one end of the original with the other end of the original aligned with the reference edge member P. Integrally movable with the slidable indicator member 24 is a switch board 25 having first and second cutter actuating switches S1, S2 separated by the distance l and a return initiating switch S3 actuatable by a switch actuating rod 26 projecting from the first carriage 3. Also actuatable by the switch actuating rod 26 are first and second paper feed initiating switches S4, S5 respectively provided at the positions separated by the distances a and b from the edge of the reference edge member P by which the end of the original O is aligned. The first paper feed initiating switch S4 when actuated initiates the feeding of copying paper C for copying at 1:1 copying ratio and the second paper feed initiating switch S5, when actuated, will initiate the feeding of copying paper for copying at copying ratio of other than 1:1, for example 1:0.708. The first and second cutter actuating switches S1, S2 are for energizing the cutting means 19 and for deenergizing the feed rollers 18*a*, 18*b* wherein the first switch S1, when actuated by the switch actuating rod 26 as the carriage 3 moves, enables the copying paper C to be cut into a length of the reproduced size, i.e., the paper will be cut into the length of the original O at 1:1 copying ratio and into the length of reproduced image at copying ratio other than 1:1 as long as the indicator member 24 is aligned with one end of original O. The return initiating switch S3 is for returning carriages 3, 7 to original positions. The locations of these various switches are determined by the velocities of the carriages 3, 7 as well as by other factors and for the better understanding of this function, the reference should be made to a copending U.S. patent application Ser. No. 751,412 filed on Dec. 16, 1976.

Reference will now be made to FIGS. 2 through 5 which show the feeding and cutting control mechanism for roll type paper employed in the apparatus of FIG. 1.

Figure 3:
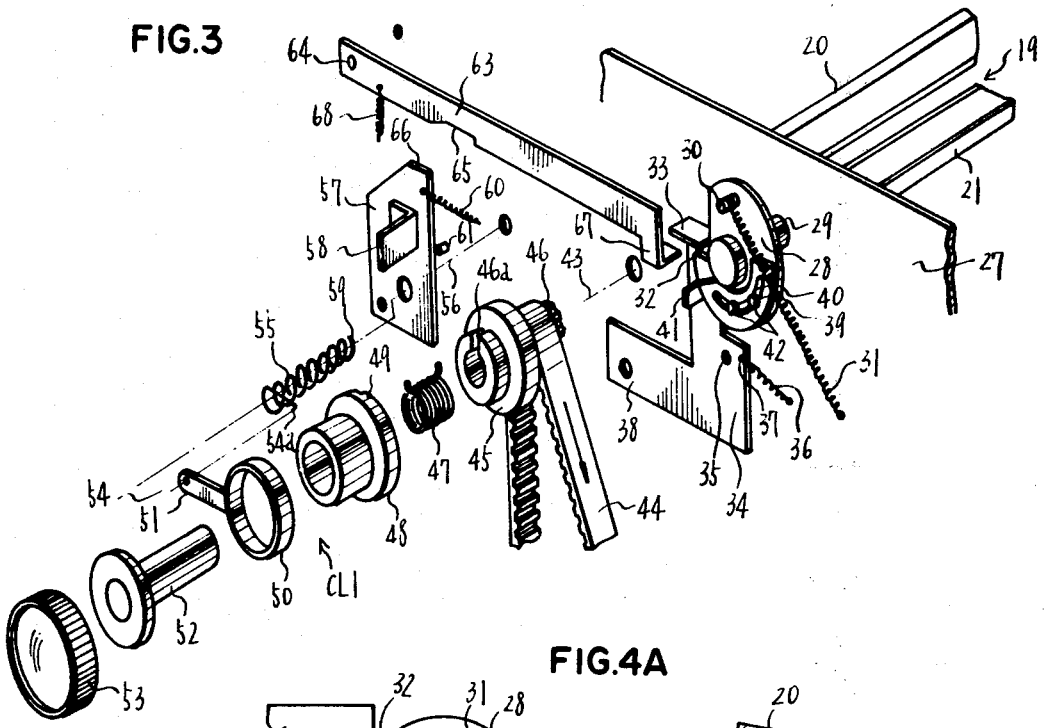
FIG. 3 is an exploded perspective view of the control mechanism of FIG. 2.

The cutting means 19, as more clearly seen in FIG. 3 consists of the fixed blade 20 and the single revolutional blade 21 and provided along the path of copying paper C. At one end of the single revolutional blade 21 but at the other side of a frame 27, a disc 28 is secured to one end of rotary shaft 29 of the single revolutional blade 21. Hooked to a pin 30 located on the disc 28 is a cutter operating spring 31 which urges the discs 28 in the clockwise direction for the rotation of the disc 28. The disc 28 is formed with a detent or a shoulder or cut-away portion 32 for locking engagement with a locking portion 33 of a cutter actuating lever 34. The locking portion 33 projects horizontally from the cutting actuating lever 34 for normally engaging with the cut-away portion 32 to prevent the disc 28 from rotating. The cutter actuating lever 34 is so disposed to be rotatable about an axis 35 and urged in the clockwise direction by a spring 36 having one end connected to a stop pin 37 formed on the lever 34. The lever 34 further includes an actuation end 38 to which a plunger 39*a* of the solenoid SL1 is coupled.

The disc 28 further includes a timing member 39 of arc shape having an arcuate elongated slot 40 and a lever actuating member 41 projecting therefrom at one end. The timing member 39 is secured on the disc by a plurality of screws 42 and the position thereof is adjustable through the slot 40 in arcuate direction.

A drive shaft 43 of the roller 18*b* of the intermittently driven paper feed rollers 18*a*, 18*b* is powered by a timing belt 44 connected to a drive source (not shown) through a spring clutch mechanism CL1 for rotation the rollers 18*a*, 18*b*. The spring clutch mechanism CL1 as shown in FIG. 3 includes, on the drive shaft 43, a rotatable boss 45 adjacent a gear 46 carrying the timing belt 44 and having a notch 46*a*, a clutch spring 47 one end of which engages the notch 46*a*, a brake drum 48 having a notch 49 in which the other end of the clutch spring 47 is held, a brake ring 50 of an inner diameter greater than the outer diameter of the brake drum 48 and having an arm 51 projecting radially outwardly therefrom, a clutch drum 52 integral with the drive shaft 43 and a cover 53. All of these elements are coupled together to form the spring clutch mechanism CL1, the function of which will be hereinafter described.

Figure 2:
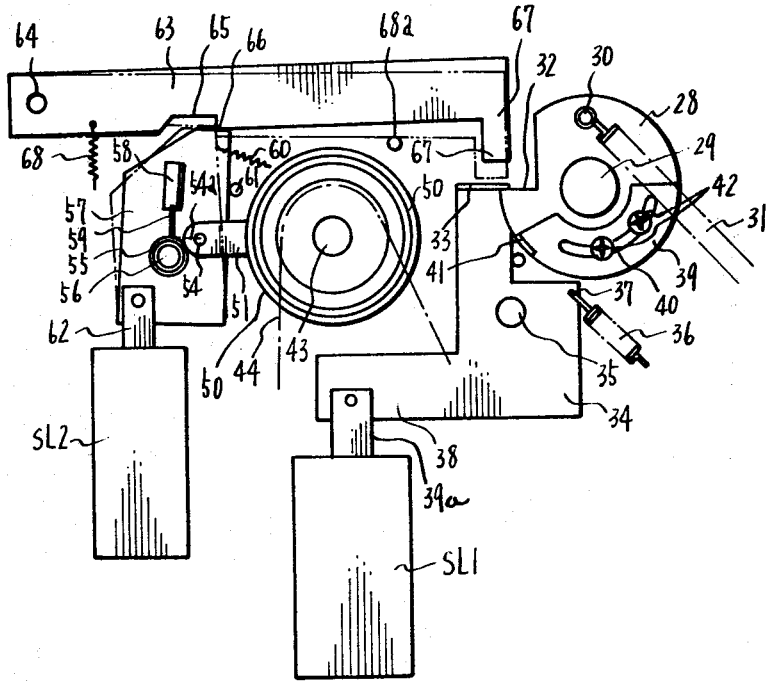
FIG. 2 is a longitudinal sectional view of the control mechanism showing the relationships of the clutch and various levers in accordance with a first embodiment of the present invention.

Coupled to the arm member 51 of brake ring 50 through a bore 54 is an end portion 54*a* of coil spring 55 would tightly over a fixed shaft 56. Rotatably supported on this fixed shaft 56 is a clutch actuating lever 57 having an L-shaped projecting member 58 and the other end portion 59 of the coil spring 55 is in engaging contact with the projecting member 58. The clutch actuating lever 57 is normally urged in the clockwise direction by a spring 60 secured thereto and limited in its clockwise movement by a pin 61 provided on the frame 27. The lever 57 is coupled to a plunger 62 of solenoid SL2 at its lower end and is normally at the position shown by solid lines (FIG. 2).

Disposed above the lever 57 is a locking lever 63 rotatable about an axis 64 and being of substantially an L-shaped form. The locking lever 63 includes a notched portion 65 with which a top end portion 66 of the clutch actuating lever 57 engages when the lever 57 is rotated in counter-clockwise direction against the urging force of the spring 60 by the energization of the solenoid SL2. The lever 63 is further formed with a projecting portion 67 with which the lever actuating member 41 of the timing member 39 on the disc 28 abuts when the disc 28 is rotated together with the single revolutional blade 21. The lever 63 is urged in the clockwise direction by a spring 68 secured thereto and limited in its clockwise movement by a pin 68*a*.

Figure 4A:
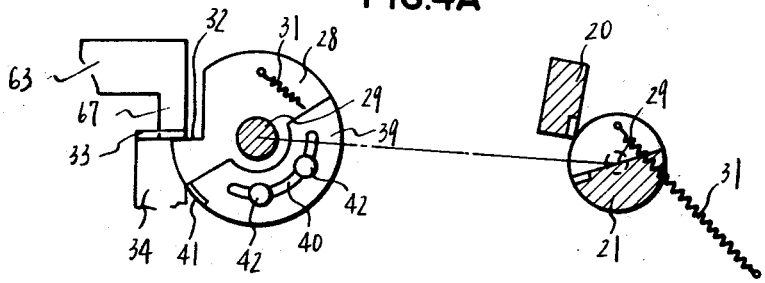
FIGS. 4A through 4C are sectional views, partly broken away, showing the operational sequences of the control mechanism and cutting means at successive stages.
Figure 5:
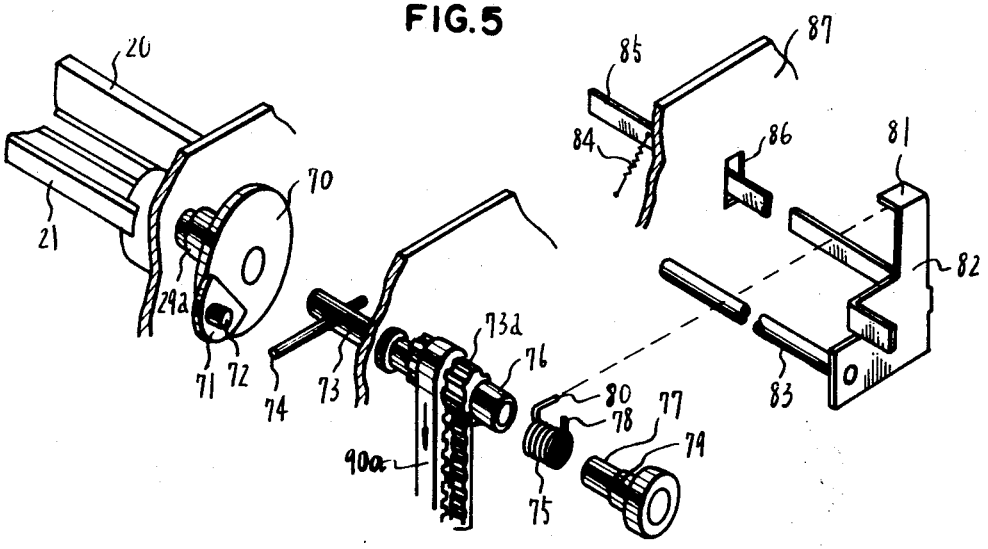
FIG. 5 is an exploded perspective view of a part of the control mechanism showing particularly the winding mechanism of the cutting means.

At the other end of the rotary shaft 29 for the single revolutional blade 21 is provided a winding mechanism for the blade 21 as a part of the feeding and cutting control mechanism in accordance with the present invention as shown in FIG. 5. This winding mechanism is for rotating the blade 21 for one complete rotation to bring the same to a spring-charged condition as shown in FIGS. 2, 3 and 4A. Specifically, the winding mechanism includes a disc 70 which is secured at the opposite end of blade 21 through a shaft 29*a* and which has a semi-circular cam 71 and a pin 72 formed thereon. Another winding shaft 73 is rotatably provided along the axis of rotary shaft 29*a* and has an actuating bar 74 at one end for abutment with the pin 72 of the semi-circular cam 71. Also provided on the winding shaft 73 is a rotatably supported gear 73*a* engaged by a timing belt 90*a* suspended thereover to transmit drive power from a drive source not shown. In addition, a clutch spring 75 surrounds a drum 76 which is rotatably supported on shaft 73 together with a boss 77 secured to the other end of the shaft 73 and with the gear 73*a*, in a manner such that one end 78 of the clutch spring 75 engages a notch 79 in the boss 77 and the other end 80 thereof engages a locking end 81 of a rocking lever 82. The rocking lever 82 is rotatably supported on shaft 83 and urged so as to rotate in the clockwise direction under the urging force of spring 84 acting on operating part 85 thereof which extends through window 86 in frame 87, and restricted by the window 86 in frame 87.

Considering now the operation of the control mechanism described above, FIG. 4A shows the charged condition of the single revolutional blade 21 of cutting means 19 in which the blade 21 together with the disc 28 is urged by the cutter operating spring 31 in the clockwise rotational direction with its rotation prevented by the engagement of the locking portion 33 of cutter actuating lever 34 with the shoulder or cut-away portion 32 in the disc 28. Accordingly the clutch actuating lever 57 and the locking lever 63 are at the positions shown by solid lines in FIG. 2 until a paper feed initiating signal is received by the solenoid SL2. Also, in the charged condition, timing belt 44 is rotated by means of a drive source (not shown) to rotate the boss 45 through the medium of gear 46 but without the driving power transmitted to the drive shaft 43 which rotates the paper feed rollers 18*a*, 18*b*.

In operation, an original O to be copied is placed on the glass plate 2 of the apparatus M of FIG. 1 with one end of the original aligned with the reference edge member P. Then the slidable indicator member 24 is slid along the original for alignment with the other end of the original. With a print switch (not shown) actuated, the first carriage 3 together with the second carriage 7 begin their scanning movements in the direction to the left. The switch actuating rod 26 on the first carriage 3 actuates either the first or the second paper feed initiating switch S4, S5 depending on the copying ratios at which copying is carried out.

The actuation of either of the switches S4, S5 energizes the feeding solenoid SL2 and by this, the plunger 62 is pulled to pivot or rotate the clutch actuating lever 57 in the counter-clockwise direction against the urging force of the spring 60. The pivotal rotation of the lever 57 cause the top end portion 66 thereof, which was in contact with a portion adjacent the notch 65 of the locking lever 63, to engage with the notch 65 of the locking lever 63 as the lever 63 rotates in the clockwise direction about the axis 64. Thus, both the levers 57 and 63 will be at the positions shown by phantom lines in FIG. 2 and these positions will be maintained even after the deenergization of the feeding solenoid SL2. Together with the pivotal movement of the clutch actuating lever 57, the L-shaped projecting member 58 which engages with the end portion 59 of the coil spring 55 causes the coil spring 55 to be rotated in the counter-clockwise direction and in consequence, the end portion 54*a* thereof pulls the arm member 51 of brake ring 50 toward left in FIG. 2. As a result, the brake ring 50 interrupts rotation of brake drum 48, so that the rotation of clutch spring 47 as well is stopped because one end of the clutch spring 47 is engaged with the notch 49 of the brake drum 48. Since boss 45 continues rotating by the timing belt 44, the clutch spring 47 tightens about the clutch drum 52 by the engagement of the other end of clutch spring 47 with notch 46*a* of the boss 45 to transmit driving power from timing belt 44 to drive shaft 43. Accordingly, the feeding of copying paper C whose leading edge is at the cutting means 19 is initiated by the rotation of paper feed rollers 18*a*, 18*b*.

Figure 4B:
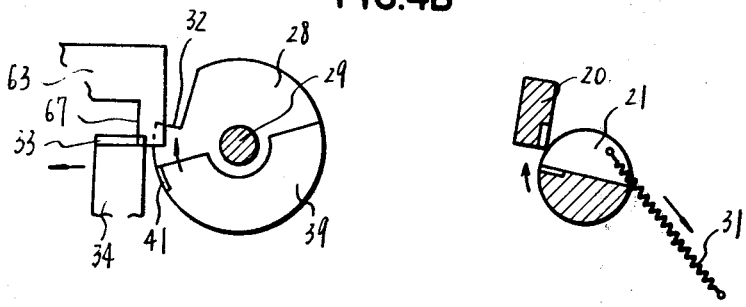

As the copying paper C is continued to be fed and when the switch actuating rod 26 of the first carriage 3 actuates either the first or second cutter actuating switch S1, S2, depending on the copying ratio, the cutter solenoid SL1 is energized. FIG. 4B shows just this moment and the energization of solenoid SL1 pulls the actuating end 38 of cutter actuating lever 34 by means of plunger 39*a* to pivot or rotate the lever 34 in the counter-clockwise direction about the axis 35 against the force of spring 36. The pivotal movement of the cutter actuating lever 34 permits the locking portion 33 thereon to retreat toward left from the abutment with the cut-away portion 32 of disc 28. This enables the disc 28 to rotate in the clockwise direction about the shaft 29 by the cutter operating spring 31. The single revolutional blade 21 rotates accordingly with the rotation of disc 28 and engages with the fixed blade 20 to cut copying paper C. Integrally with the rotation of disc 28, the timing member 39 having lever actuating member 41 approaches and abuts the protruding portion 67 of locking lever 63.

Figure 4C:
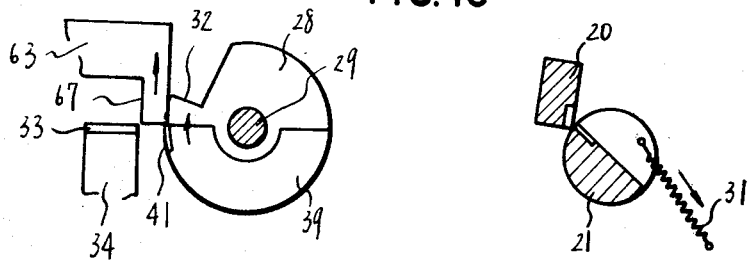

FIG. 4C shows the moment lever actuating member 41 abut the protruding portion 67. The abutment of lever actuating member 41 with the projecting portion 67 causes the locking lever 63 to be raised about the axis 64 and in consequence, the top end portion 66 of clutch actuating lever 57 engaged with the notched portion 65 of the locking lever 63 is disengaged therefrom. The clutch actuating lever 57 thus is rotated in the clockwise direction under the influence of the spring 60 and accordingly the brake ring 50 is released from a tension with the brake drum 48 as the coil spring 55 loosens, and this gradually releases the tightening force of clutch spring 47 over the clutch drum 52 which is integral with the drive shaft 43. As a result, the transmission of a drive force to the drive shaft 43 of paper feed roller 18*b* is released to stop the rotations of paper feed rollers 18*a*, 18*b*. The feeding of copying paper is accordingly terminated with the paper cut to a predetermined length. As has been previously noted, a time interval between the cutting of paper and termination of paper feed is determined by the position of lever actuating member 41 of the timing member 39 and the position of the same may be adjusted through the elongated slot 40 by loosening screws 42. In addition, the amount or length of copying paper projecting from the cutting means 19, i.e., from the edge of fixed blade 20 is substantially held constant from one cutting to another as the termination of paper feed (i.e., stoppage of feed rollers 18*a*, 18*b*) is accomplished by the action or movement of the single revolutional blade 21.

The winding of the single revolutional blade 21 after the cutting of the paper is accomplished in the following manner as shown in FIG. 5. During the cutting and paper feed terminating operation described above, the disc 70 having semi-circular cam 71 formed with pin 72 and secured to the rotary shaft 29*a* to which the single revolutional blade 21 and the disc 28 are also secured rotate integrally with the rotary shaft 29*a*. During the rotation of blade 21 by the cutter operating spring 31, the semi-circular cam 71 on the disc 70 strikes or contacts with the operating part 85 of rocking lever 82 to rotate the rocking lever 82 in the clockwise direction about the shaft 83 against the urging force of spring 84. By this, the locking end 81 of lever 82 retreats rightwardly to release the engagement of the end 80 of clutch spring 75 therefrom. The clutch spring 75 thus tightens over the boss 77 and the drum 76 to transmit the rotation of timing pulley 73*a* driven by the timing belt 90 to winding shaft 73 through the boss 77 and rotates the shaft 73 in the counter-clockwise direction. As a result, the actuating bar 74 at one end of the winding shaft 73 starts to rotate therewith and engages in contact with the pin 72 on the semi-circular cam 71 of the disc 70. At this point in time, the cutter operating spring 31 connected to the disc 28 will be at bottom dead center, i.e., fully contracted. Nevertheless, the actuating bar 74 on the winding shaft 73 rotates the disc 70 in the counter-clockwise direction against the force of cutter operating spring 31 to wind or to further rotate the blade 21. During this wind-up rotation of the discs 28, 70 together with the blade 21, the cutter operating spring 31 which had been contracted is stretched fully to its top dead center to urge the disc 28 as well as the blade 21 and the other disc 70 in the clockwise direction. However, the cutter solenoid SL1 having been deenergized with the cutter actuating lever 34 returned to its initial position of FIG. 2 by the spring 36, the cut-away shoulder portion 32 of disc 28 engages to be locked by the locking portion 33 of cutter actuating lever 34. Simultaneously, the end 80 of clutch spring 75 on the winding shaft 73 which was disengaged by the hitting action of cam 71 with the operating part 85 of rocking lever 82 engages with the locking end 81 of rocking lever 82 and in consequence, a tightening force of clutch spring 75 acting on the boss 77 and the drum 76 is released so that a drive force to the winding shaft 73 from the timing gear 73*a* is no longer transmitted. This then completes the single operation with each element returned to its initial position to repeat the same function for another cutting of the copying paper. In summary, the single revolutional blade 21 for cutting means 19 cuts and stops feeding paper and automatically wound to the spring-charged condition during a single rotation of the disc.

Although the single revolutional blade 21 is operated by the cutter operating spring 31 in the above embodiment, it should be noted that the blade 21 may similarly be operated by means of a solenoid and the like. Furthermore, deenergization of paper feed rollers 18*a*, 18*d* may be accomplished in a different manner which receives a signal for deenergizing paper feed means directly by the actuation of cutting means and FIGS. 6 and 7 show such system.

Figure 6:
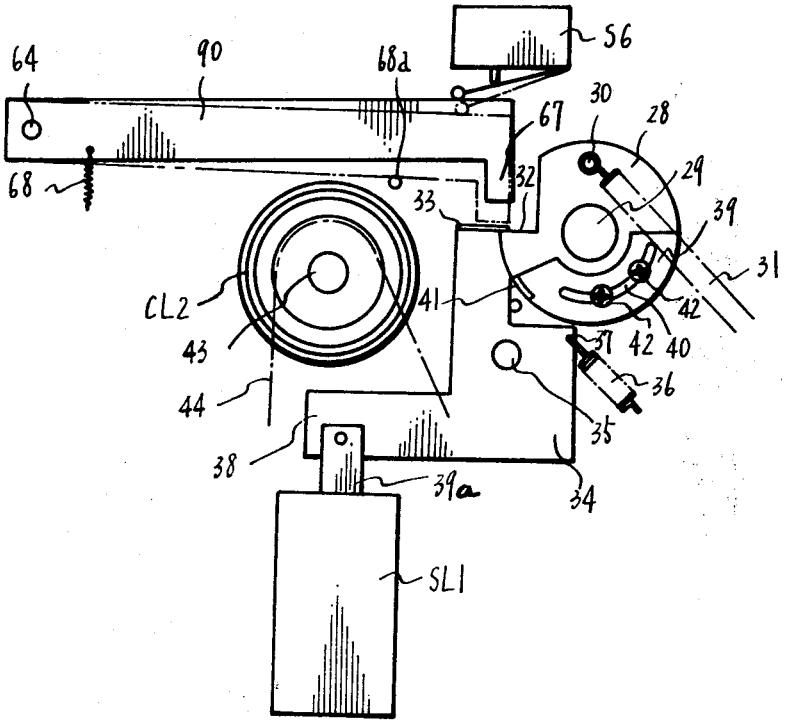
FIG. 6 is a longitudinal sectional view of the control mechanism in accordance with a second embodiment of the present invention.
Figure 7:
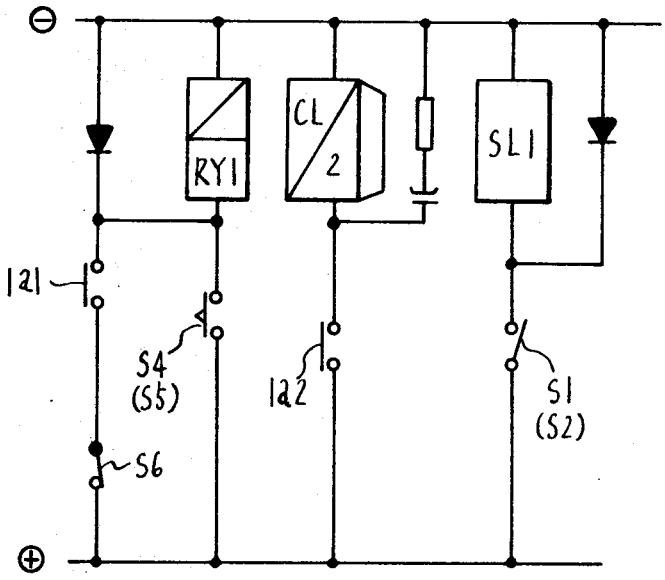
FIG. 7 is a simplified electrical circuit diagram for the control mechanism of FIG. 6.

As seen in FIG. 6, a clutch control switch S6 is provided in place of the clutch actuating lever 57 and its related elements in the first embodiment for actuation by the locking lever 90. The locking lever 90 is substantially similar in its shape and function as with the locking lever 63 of the first embodiment and the only difference is that it has no notched portion 65 as there is no clutch actuating lever 57 in this embodiment. In addition, the spring clutch mechanism CL1 on the drive shaft 43 is substituted for an electromagnetic clutch CL2 of a well known type and the rest of the mechanism such as disc 28, cutter actuating lever 34 and their related elements are the same as with the first embodiment shown in FIGS. 1 through 5.

In operation, the paper feed initiating switch S4 or S5 is actuated by the switch actuating rod 26 on the first carriage 3 immediately after its scanning movement (FIG. 1). This energizes a relay RY1 to self-hold contacts 1a1 and 1a2 which in turn energizes the electromagnetic clutch CL2 to initiate rotation of paper feed rollers 18*a*, 18*b* through the drive shaft 43 as shown in FIG. 7. As the paper is drawn from the roll R and when a predetermined length is fed, the switch actuating rod 26 actuates first or second cutter actuating switch S1, S2. A signal is accordingly sent to cutter solenoid SL1 to energize the same and the locking engagement of locking portion 33 of cutter actuating lever 34 with cut-away portion 32 of disc 28 is released by the pivotal movement of cutter actuating lever 34 in the counter-clockwise direction about the axis 35. The disc 28 is accordingly rotated by the urging force of cutter operating spring 31 and the lever actuating member 41 on timing member 39 moving integrally, abuts the protruding portion 67 of locking lever 90. The lever 90 is thus rotated upwardly to actuate clutch control switch S6. The deactuation or opening switch S6 releases the self-hold conditions of contacts 1a1, 1a2 of relay RY1 to deenergize the electromagnetic clutch CL2. The feeding of paper is accordingly terminated and this operation will be repeated for another cutting of paper. It should be noted that the clutch control switch S6 may be operated directly by the lever actuating member 41 without the intermediate means of locking lever 90.

Referring now to third embodiment of the present invention shown in FIGS. 8 through 12, the primary difference with the first embodiment is in the division of disc 28 and timing member 39 having lever actuating member 41 into two separate members with the former provided on the winding shaft 73 and the latter on the rotary shaft 29.

Figure 8:
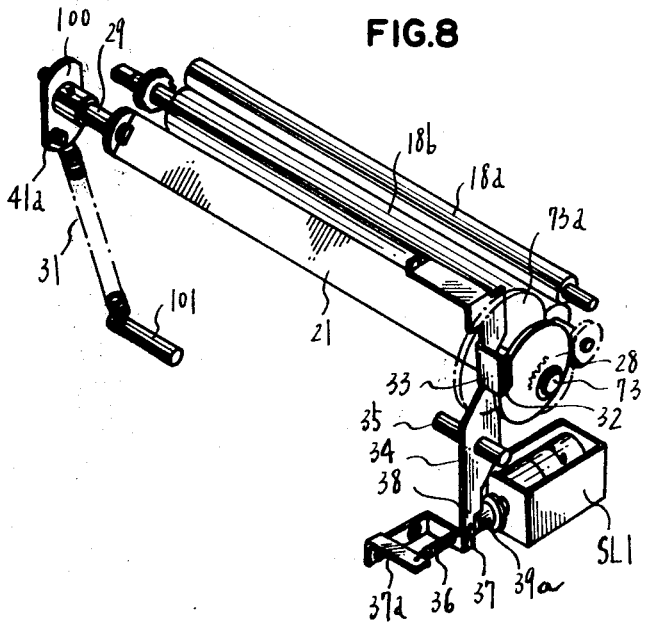
FIG. 8 is a perspective view of the control mechanism in accordance with a third embodiment of the present invention.
Figure 11:
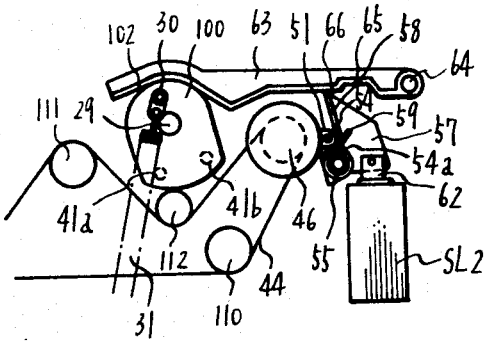
FIGS. 11 and 12 are sectional view showing the operational sequences of the control mechanism.
Figure 12:
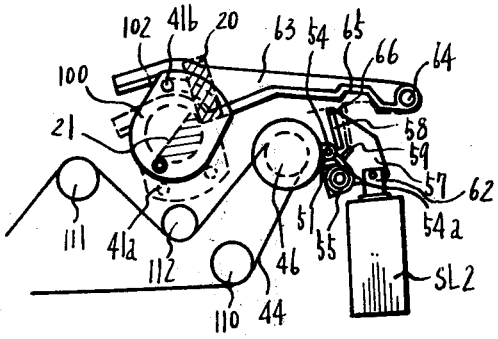

Specifically, in FIG. 8, a cutter rotating cam 100 is fixedly supported at one end of rotary shaft 29 to which the single revolutional blade 21 is secured. Hooked to a pin 30 formed on the cam 100 is a cutter operating spring 31 with the other end fixed to a bar 101 and the spring 31 urges the cam 100 in the clockwise direction with the rotation by rotary shaft 29. The cutter rotating cam 100 further includes first and second lever actuating members or pins 41*a*, 41*b* for engagement with a locking lever 63. The locking lever 63 shown in FIGS. 11 and 12 is disposed over the cam 100 and is rotatable about an axis 64 and urged in the counter-clockwise direction by a spring (not shown). The lever is so formed with an arcuate detent portion 102 for engagement with lever actuating members 41*a*, 41*b* of cam 100 and with a notched portion 65 for engagement with a top end portion 66 of clutch actuating lever 57 the detail of which will be explained hereinafter.

Figure 9:
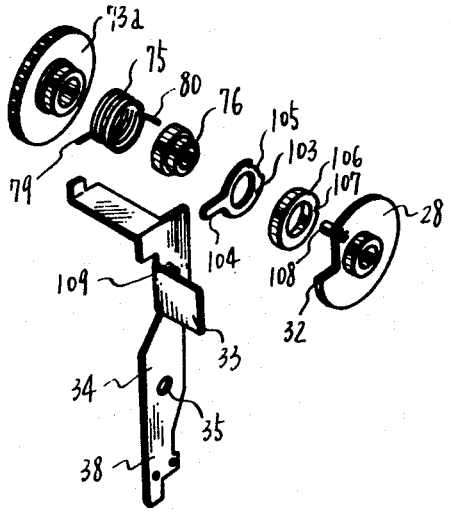
FIG. 9 is an exploded perspective view of the winding-up mechanism of the control mechanism of FIG. 8.
Figure 10:
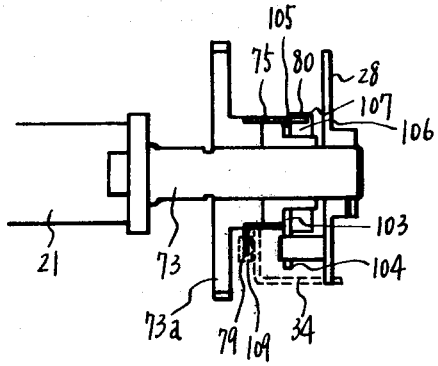
FIG. 10 is a sectional view of winding up mechanism showing the coupling relation of the various elements shown in FIG. 9.

At the opposite end of blade 21 to which a winding shaft 73 is secured, a winding-up mechanism for blade 21, which consists of a winding or timing gear 73*a* over which extends a timing belt (not shown, but similar with the timing belt 90 shown in FIG. 5) a clutch spring 75 having ends 79, 80, a clutch drum 76, a winding ring 103 having an arm member 104 and formed with a notch 105, a collar 106 with another notch 107 and a disc 28 having an actuating pin 108 and a cut-away or shoulder portion 32, is provided over the winding shaft 73 as shown in FIG. 9. As is apparent, the disc 28 on the winding shaft 73 is urged in the clockwise direction by the cutter operating spring 31 of the cutter rotating cam 100 and the cut-away shoulder portion 32 of the disc 28 is normally in locking engagement with a locking portion 33 of a cutter actuating lever 34. The cutter actuating lever 34 is so disposed as to pivot about an axis 35 and is urged in the clockwise direction by a spring 36 having one end secured to a stop pin 37 formed on the lever 34 with the other end held by securing member 37*a*. To an actuation end 38 of the lever 34, a cutter solenoid SL1 is coupled through a plunger 39*a*. The cutter actuating lever 34 further includes an engaging pin 109 on the rear face thereof and with this engaging pin 109, one end 79 of clutch spring 75 is normally engaged. On the other hand, the other end 80 of clutch spring 75 is engaged through the notches 105, 107 of winding ring 103 and collar 106 with the clutch spring 75 disposed to surround over a part of winding gear 73*a* and the clutch drum 76 as shown in FIG. 10. The projecting member 104 of the winding ring 103 is adapted to engage with the actuating pin 108 on the disc 28 to wind the disc 28, the operation of which will be hereinafter described.

The paper feed commencing and terminating means are substantially the same as with the first embodiment. As shown in FIG. 11 or 12, a drive shaft 43 of the roller 18*b* of the intermittently driven paper feed rollers 18*a*, 18*b* is driven by a timing belt 44 extending around gears 46, 110, 111, 112 through a spring clutch mechanism CL1 shown in FIG. 3 of the first embodiment. A clutch actuating lever 57 as well as its related elements are also the same as with the first embodiment and connection of lever 53 with an arm member 51 of brake ring 50 by a coil spring 55 on the shaft 56 is also the same.

In operation, the timing gear 46 as well as winding gear 73*a* are driven by the timing belt 44 and by the other belt without any drive force transmitted to drive shaft 43 and rotary shaft 29. When the paper feed initiating switch S4 or S5 is actuated, the solenoid SL2 energizes to rotate or pivot the clutch actuating lever 57 in the clockwise direction, as viewed in FIG. 11. The rotation of lever 57 pivots the locking lever 63 about the axis 64 and locks the clutch actuating lever 57 in engagement with notched portion 65 of the lever 63. By this, the coil spring 55 on the clutch actuating lever 57 pulls the arm member 51 of brake ring 50 to tighten clutch spring 47 over the drive shaft 43. Accordingly, the drive shaft 43 is rotated to rotate paper feed rollers 18*a*, 18*b* to initiate paper feeding. (For further detail of this operation, refer to the description of first embodiment).

After paper has been fed a predetermined length, the cutter actuating switch S1 or S2 is actuated to energize the cutter solenoid SL1. The energization of solenoid SL1 causes the cutter actuating lever 34 to rotate in the counter-clockwise direction about the axis 35 against the urging force of spring 36 so that the locking engagement of locking portion 33 of the lever 34 with cut-away portion 32 of the disc 28 is released. This disc 28 on the winding shaft 73 together with the cutter rotating cam 100 on the rotary shaft 29 carrying the single revolutional blade 21 is accordingly rotated by the urging force of cutter operating spring 31. The rotation of cutter actuating lever 34 also causes the disengagement of the one end 79 of clutch spring 75 from the engaging pin 109 on the lever 34 and in consequence, the clutch spring 75 tightens over the clutch drum 76 to transmit a drive force to the winding shaft 73 through the rotation of gear 73*a*. By this transmission of drive power to the shaft 73, the projecting member 104 of winding ring 103 engages in contact with the actuating pin 108 on the disc 28 to effect the continued rotation of the disc 28. Thus, the transmission of drive force to the winding shaft 73 causes the winding rotation of the blade 21 which is carried by rotary shaft 29 and winding shaft 73 on which the cam 100 and disc 28 are provided.

As the cutter rotating cam 100 rotates, lever actuating members 41*a*, 41*b* engage the arcuate detent portion 102 of the locking lever 63 to pivot the same upwardly. This in turn causes the release of engagement of clutch actuating lever 57 with the notched portion 66 of locking lever 63. The lever 63 is accordingly rotated to its initial position about the shaft 56 and as a result, a tightening force of clutch spring 47 over the drive shaft 43 is released to stop the rotation of rollers 18*a*, 18*b*. The disc 28 together with the blade 21 and cam 100 on the shafts 29, 73 are continued to be rotated by the drive force transmitted to the shaft 73 as explained above and their rotations are terminated upon engagement of cut-away portion 32 of the disc 28 with the locking portion 33 of cutter actuating lever 34. This accordingly completes one full rotation of blade 21 and repeats the same operation for another cutting of paper.

Having described the invention in connection with certain specific preferred embodiments thereof, it is to be understood that further modifications may now suggest themselves to those skilled in the art and it is intended to cover such modifications as fall within the scope of the appended claims.

We claim:

1. In a feeding and cutting control mechanism for roll storage paper comprising:

means for feeding the paper drawn from said roll storage along a predetermined path;

clutch means transferrable between engage and disengage conditions for actuating and deactuating said feeding means;

cutting means disposed along said path for cutting said paper and including a single cycle rotatable cutter;

cutter rotating means for rotating said cutter a single revolution;

transmission means intercoupling said clutch means and cutting means for disengaging said clutch means during the rotation of said cutter, said paper being cut by said cutter rotated by said cutter rotating means and said paper feeding being terminated when said clutch means is disengaged by said transmission means during a single revolution of said single revolutional cutter, and termination of said paper feed occurring momentarily after said cutting of said paper, said transmission means including a timing member synchronously rotatable with said cutter and a deactuating means actuatable by said timing member, said deactuating means disengaging said clutch means when actuated by said timing means during a single rotation of said cutter and momentarily following the cutting of said paper.

2. In a feeding and cutting control mechanism for roll stored paper comprising:

means for feeding paper drawn from said roll stored paper along a predetermined path and including clutch means transferrable between engage and disengage positions;

cuttting means disposed along said path and including a fixed blade and a single revolutional blade movable across said path;

means for rotating said blade including a first rotating means for rotating said blade initially and a second rotating means for continuing rotation of said blade for one complete revolution;

means for preventing rotation of said blade and movable to initiate rotation of said blade; and transmission means intercoupling said clutch means and cutting means for disengaging said clutch means during the rotation of said single revolutional blade including a control means rotatable in synchronism with the rotation of said blade and a deactuating means actuatable by said control means for disengaging said clutch means;

said blade being initiated for rotation upon movement of said preventing means and cutting the paper during its rotation, and said clutch means being disengaged by the actuation of said deactuating means by said control means to terminate the feeding of paper as said blade is rotated with rotation of said blade being terminated upon one complete cycle by said preventing means.

3. A mechanism for cutting predetermined lengths of sheet from a storage roll of said sheet comprising:

means for advancing a sheet withdrawn from said roll along a predetermined path;

means for driving said roll withdrawn sheet including a drive clutch having a control member transferrable between clutch engage and disengage conditions for respectively effecting and discontinuing the advance of said sheet;

a cutter member including a transversely extending blade movable across said path to cut said sheet;

a transversely extending shaft supporting said blade and rotatable to rotate said blade from a retracted position across said predetermined path;

means for actuating said cutter member a single cutting cycle and including a spring eccentrically connected to said shaft and when loaded urging said shaft to rotate said blade in an advance direction across said predetermined path and being loaded with further advance rotation of said shaft to bias said spring to its loaded condition with said blade in its retracted position;

means for releaseably locking said blade in its retracted position;

solenoid actuated means for releasing said blade for advance movement thereof; and control means for disengaging said clutch during said cutting cycle including a timing member rotatable with said shaft and a motion transmission means coupling said timing and control members for disengaging said clutch at positions of said timing member during said cutting cycle.

4. The cutting mechanism of claim 3 including means releasably locking said transmission means in its clutch engage condition.

5. The cutting mechanism of claim 4 including solenoid means for advancing said transmission means to its clutch engage position.

6. The cutting mechanism of claim 3 wherein said drive clutch is an electromagnet clutch and said control means comprises a switch connecting said clutch to a source of current and means for actuating said clutch in response to the position of said blade supporting shaft.

7. The cutting mechanism of claim 4 including spring means biasing said transmission means to its clutch engage condition.

* * * * *

UNITED STATES PATENT AND TRADEMARK OFFICE

CERTIFICATE OF CORRECTION

PATENT NO. : 4,143,570

DATED : March 13, 1979

INVENTOR(S) : Hirohisa Fujimoto et al

It is certified that error appears in the above–identified patent and that said Letters Patent are hereby corrected as shown below:

The drawing figure below should appear on the cover sheet.

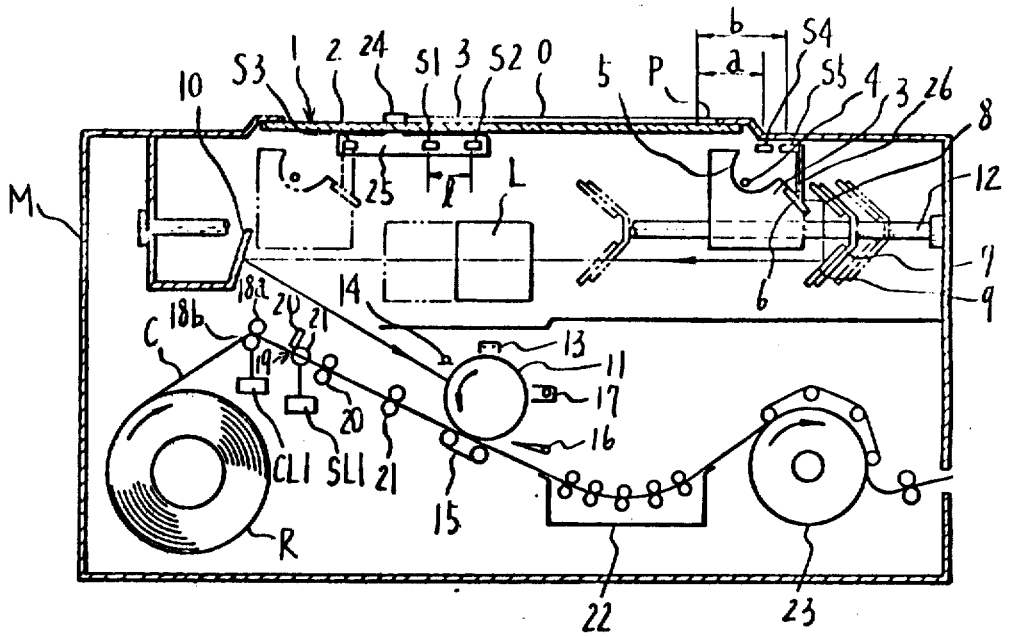

Signed and Sealed this

Nineteenth Day of June 1979

[SEAL]

Attest:

RUTH C. MASON
Attesting Officer

DONALD W. BANNER
Commissioner of Patents and Trademarks